US007398612B2

(12) United States Patent
Zheng

(10) Patent No.: US 7,398,612 B2
(45) Date of Patent: Jul. 15, 2008

(54) COLLAPSIBLE SUPPORT FRAMES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 11/516,077

(22) Filed: Sep. 6, 2006

(65) Prior Publication Data

US 2007/0011927 A1 Jan. 18, 2007

Related U.S. Application Data

(60) Continuation of application No. 10/072,021, filed on Feb. 7, 2002, now abandoned, which is a division of application No. 09/286,800, filed on Apr. 6, 1999, now Pat. No. 6,357,510.

(51) Int. Cl.
*G09F 15/00* (2006.01)

(52) U.S. Cl. ..... 40/603; 135/126; 135/119; 135/125; 135/123; 135/143; 160/354; 160/351; 160/377; 52/646

(58) Field of Classification Search ..... 40/603, 40/610, 618, 103; 135/126; 160/354, 377
See application file for complete search history.

(56) References Cited

U.S. PATENT DOCUMENTS

| | | | | |
|---|---|---|---|---|
| 2,430,714 | A | | 11/1947 | Geer |
| 3,125,155 | A | | 3/1964 | Frommelt et al. |
| 3,174,493 | A | | 3/1965 | Gruenberg |
| 3,484,974 | A | * | 12/1969 | Culmone ..... 40/586 |
| 3,826,270 | A | | 7/1974 | Hentges |
| 4,134,439 | A | | 1/1979 | Scott |
| 4,154,253 | A | | 5/1979 | McGullough |
| 4,632,138 | A | | 12/1986 | Irwin |
| 4,709,718 | A | | 12/1987 | Nichols |
| 4,815,784 | A | | 3/1989 | Zheng |
| 4,842,035 | A | | 6/1989 | Thompson |
| 4,858,634 | A | | 8/1989 | McLeese |
| 4,951,333 | A | | 8/1990 | Kaiser et al. |
| 5,024,262 | A | | 6/1991 | Huang |
| 5,116,273 | A | | 5/1992 | Chan |
| 5,137,044 | A | | 8/1992 | Brady |
| 5,163,461 | A | | 11/1992 | Ivanovich et al. |
| 5,213,147 | A | | 5/1993 | Zheng |
| 5,249,592 | A | | 10/1993 | Springer et al. |
| 5,301,705 | A | | 4/1994 | Zheng |
| 5,343,887 | A | | 9/1994 | Danaher |
| 5,411,046 | A | | 5/1995 | Wan |
| 5,439,017 | A | | 8/1995 | Brown |
| 5,467,794 | A | | 11/1995 | Zheng |
| 5,482,269 | A | | 1/1996 | Scott et al. |
| 5,553,908 | A | | 9/1996 | Shink |
| 5,560,385 | A | | 10/1996 | Zheng |

(Continued)

*Primary Examiner*—Lesley D. Morris
*Assistant Examiner*—Shin Kim
(74) *Attorney, Agent, or Firm*—Raymond Sun

(57) ABSTRACT

Collapsible structures are provided that have one or more support frames, each having a foldable frame member that has a folded and an unfolded orientation, with the frame member defining a periphery for the support frame. Where more than one support frame is provided, the support frames can be hingedly coupled to each other. The frame member(s) can be used, for example, to support panel pieces, objects and coverings, among others. In some embodiments, one or more objects can be coupled to and supported by the support frame (s). In other embodiments, a covering may be placed over the support frame(s).

6 Claims, 15 Drawing Sheets

U.S. PATENT DOCUMENTS 5,579,799 A 12/1996 Zheng
5,638,850 A 6/1997 Hazinski et al.
5,645,096 A 7/1997 Hazinski et al.
5,664,596 A 9/1997 Zheng
5,667,066 A 9/1997 Simpson
5,722,446 A 3/1998 Zheng
5,732,759 A 3/1998 Wang
5,778,915 A * 7/1998 Zheng ..... 135/126
5,800,067 A 9/1998 Easter
5,816,279 A 10/1998 Zheng
5,816,954 A 10/1998 Zheng
5,927,793 A 7/1999 McGrath, Jr.
5,941,265 A 8/1999 Zheng
5,964,533 A 10/1999 Ziglar
5,975,101 A 11/1999 Zheng
6,006,772 A 12/1999 Zheng
6,030,300 A 2/2000 Zheng
6,032,685 A 3/2000 Zheng
6,045,093 A 4/2000 Zheng
6,073,283 A 6/2000 Zheng
6,073,643 A 6/2000 Zheng
6,092,544 A 7/2000 Zheng
6,098,349 A 8/2000 Zheng
6,109,281 A 8/2000 Lowenthal
6,109,282 A 8/2000 Yoon
6,155,329 A 12/2000 Hwang et al.
6,170,100 B1 1/2001 LeGette et al.
6,220,265 B1 4/2001 Zheng
6,267,129 B1 7/2001 Zheng
6,293,036 B1 * 9/2001 Westermann ..... 40/618
6,305,396 B1 10/2001 Zheng
6,325,086 B1 12/2001 Shinner et al.
6,343,391 B1 2/2002 Le gete et al.
6,357,510 B1 3/2002 Zheng
6,360,761 B1 3/2002 Zheng
6,425,150 B1 7/2002 McConnell
6,461,257 B2 10/2002 Zheng
6,502,595 B2 1/2003 Louie
6,519,793 B2 2/2003 Le Gette et al.
6,571,410 B2 6/2003 Zheng
6,691,344 B2 2/2004 Le Gette et al.
2002/0032085 A1 3/2002 Zheng
2002/0058556 A1 5/2002 Zheng
2002/0096205 A1 7/2002 Zheng
2002/0112753 A1 8/2002 Louie
2003/0066553 A1 4/2003 Zheng
2003/0115669 A1 6/2003 Le Gette et al.

* cited by examiner

COLLAPSIBLE SUPPORT FRAMES

This is a continuation of Ser. No. 10/072,021, filed Feb. 7, 2002, now abandoned which is a division of Ser. No. 09/286,800, entitled "Collapsible Support Frames", filed Apr. 6, 1999, now U.S. Pat. No. 6,357,510, whose disclosures are incorporated by this reference as though fully set forth herein.

BACKGROUND OF THE INVENTION

1. Field of the Invention

The present invention relates to collapsible structures, and in particular, to collapsible support frames that can be used to support various items, and that can be folded and collapsed to reduce the size of the frames.

2. Description of the Prior Art

Collapsible objects have recently become popular with both adults and children. Many of these collapsible objects have a plurality of panels which may be twisted and folded to reduce the overall size of the object to facilitate convenient storage and use. Each panel is comprised of a fabric or material that is supported by a resilient frame member, with the fabric or material spanning a portion of, or entirely across, the area supported by the frame member. The frame member supports the periphery of each panel, and is capable of being twisted and folded to reduce the size of each panel.

Examples of such collapsible objects are shown and described in U.S. Pat. No. 5,467,794 (Zheng), U.S. Pat. No. 5,560,385 (Zheng) and U.S. Pat. No. 5,778,915 (Zheng) in the form of collapsible structures. These structures are currently being enjoyed by many people in many different applications. For example, these structures have been provided in many different shapes and sizes for children's play indoors and outdoors. Smaller versions of these structures have been used as infant nurseries. Even smaller versions of these structures have been used as dollhouses and action figure play houses by toddlers and children. As another example, these structures have been made into tents or outdoor structures that can be used by adults and children for camping or other outdoor purposes. These structures have also been used as beach cabanas. Even animals can enjoy these structures. Some of these structures have been made into shelters that can be used by pets, both indoors and outdoors.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structures. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

Another example of collapsible objects include collapsible game and play structures, such as those illustrated in U.S. Pat. No. 5,722,446 (Zheng) and U.S. Pat. No. 5,816,954 (Zheng). These structures provide a multitude of game structures that can be enjoyed by children and adults indoors and outdoors.

Yet another example of a collapsible object includes collapsible sunshields, such as illustrated in U.S. Pat. No. 4,815,784 (Zheng). These sunshields have two interconnecting panels that span the width of the windscreen.

In all of the above-mentioned collapsible structures, the fabric or material is permanently attached (e.g., by stitching) to the resilient frame members so that each panel is provided with a fabric or material that cannot be changed unless the existing fabric or material is cut or torn, which essentially destroys the panel. As a result, these structures suffer from the drawback that they lack variety in play and use, since they can only be used for their originally intended applications.

However, there is a great benefit in providing users with variety of play and use to increase amusement value, and the number of applications to which a product can be used. Thus, there still remains a need to provide collapsible objects and structures that provide the user with increased variety of play, and which increase the number of useful applications for these objects and structures.

SUMMARY OF THE DISCLOSURE

In order to accomplish the objects of the present invention, the collapsible structures according to the present invention have one or more support frames, each having a foldable frame member that has a folded and an unfolded orientation, with the frame member defining a periphery for the support frame. Where more than one support frame is provided, the support frames can be hingedly coupled to each other. The frame member(s) can be used, for example, to support panel pieces, objects and coverings, among others. In some embodiments, one or more objects can be coupled to and supported by the support frame(s). In other embodiments, a covering may be placed over the support frame(s).

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides collapsible objects and structures that have an underlying support frame structure. The support frame structure has at least one resilient frame member that can be folded and collapsed to reduce the size of the support frame structure. The frame member(s) can be used, for example, to support one or more removable panel pieces or objects, or to support a removable covering. The principles of the present invention can be used to provide collapsible support frame structures for sunshields, dividers, partitions, play structures, game structures, shelters, tents, cabanas, displays, cabinets, or the like.

Figure 1A:
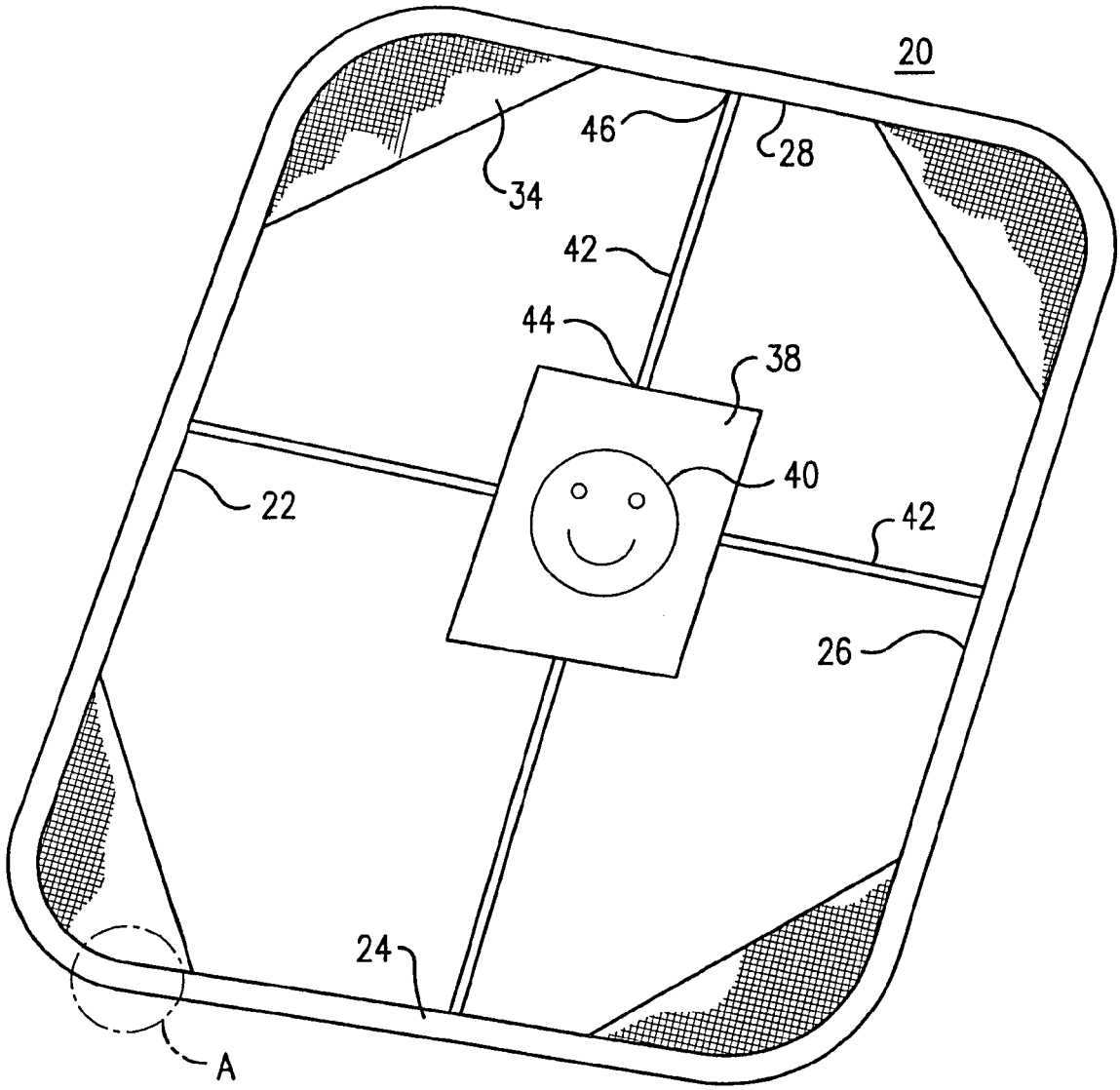
FIG. 1A is a perspective view of a singular support frame according to one embodiment of the present invention shown in use in its expanded configuration.
Figure 1B:
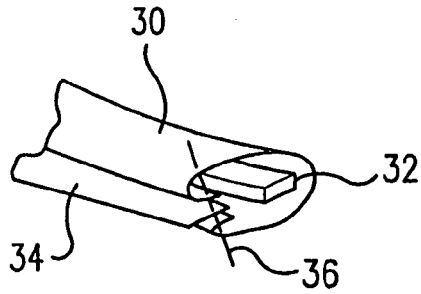
FIG. 1B is a partial cut-away view of the section A of the support frame of FIG. 1A illustrating a frame member retained within a sleeve.

FIGS. 1A and 1B illustrate a collapsible support frame structure 20 that embodies the underlying principles of the present invention. Referring to FIG. 1A, the support frame structure 20 is actually a singular support frame 20. The support frame 20 can assume any configuration, such as polygonal (see FIGS. 3 and 5), triangular (see FIG. 4), circular, oval, rectangular, square (as shown in FIG. 1A), trapezoidal, or irregular. The support frame 20 has four side edges, a left side edge 22, a bottom side edge 24, a right side edge 26, and a top side edge 28. Referring also to FIG. 1B, the support frame 20 has a continuous frame retaining sleeve 30 provided along and traversing the four edges of its four sides. A continuous frame member 32 is retained or held within the frame retaining sleeve 30 to support the support frame 20.

The continuous frame member 32 may be provided as one continuous loop, or may be a strip of material connected at both ends to form a continuous loop. The frame member 32 is preferably formed of flexible coilable steel, although other materials such as plastics may also be used. The frame member 32 should be made of a material which is relatively strong and yet is flexible to a sufficient degree to allow it to be coiled. Thus, the frame member 32 is capable of assuming two positions, an open or expanded position such as shown in FIG. 1A, or a folded position in which the frame member 32 is collapsed into a size which is much smaller than its open position (see FIG. 2E).

The frame member 32 may be merely retained within the frame retaining sleeve 30 without being connected thereto. Alternatively, the frame retaining sleeve 30 may be mechanically fastened, stitched, fused, or glued to the frame member 32 to retain the frame member 32 in position.

Optional fabric corner pieces 34 can be attached to and held taut at the corners of the support frame 20. The term fabric is to be given its broadest meaning and should be made from strong, lightweight materials and may include woven fabrics, cloth, sheet fabrics, straps, nylon, string, rope or even films. These corner pieces 34 function to provide the support frame 20 with a pre-defined configuration, especially if the support frame 20 is large in size. For example, if corner pieces 34 were omitted from the support frame 20 and the support frame 20 was large, the resilient nature of the frame member 32 may cause the support frame 20 to coil into an undefined shape. Therefore, providing four corner pieces 34 as shown in FIG. 1A would define a generally square or rectangular support frame 20, providing three corner pieces 34 would define a generally three-sided support frame (see FIG. 4), and so on, as will be illustrated in greater detail in connection with FIGS. 3-5 below.

Figure 1C:
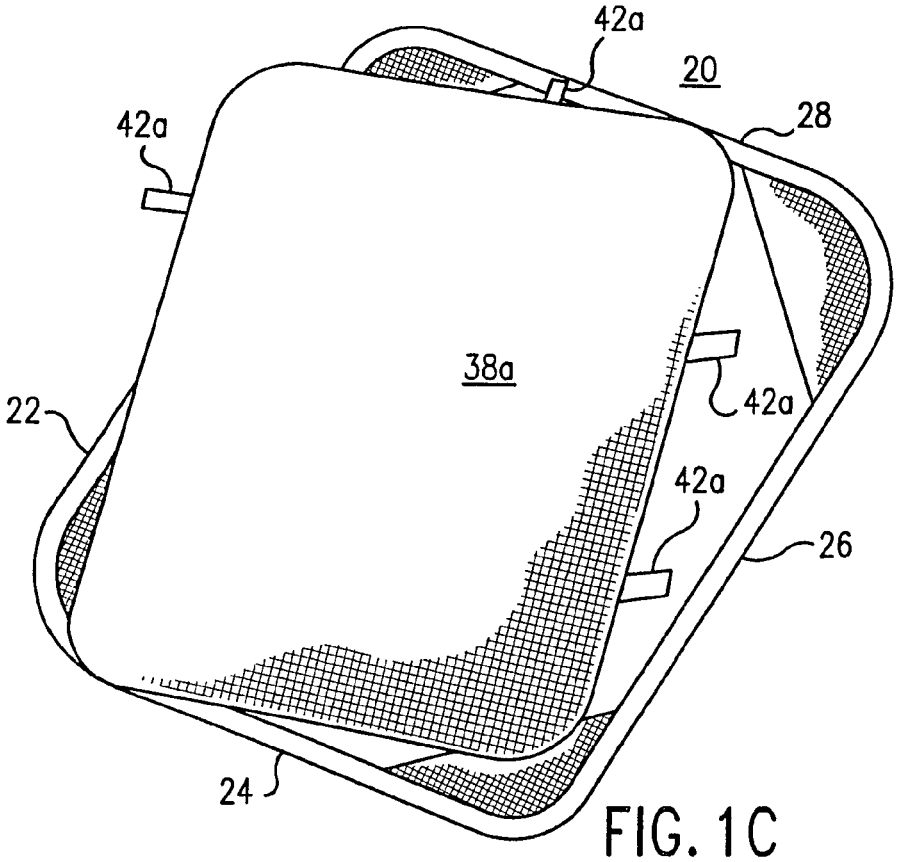
FIG. 1C illustrates a modification to the embodiment of FIG. 1A.

As best illustrated in FIG.1 B, the frame retaining sleeve 30 may be attached to each fabric corner piece 34 by applying a stitching 36 that extends along a portion of the side edges 22, 24, 26, 28. The stitching 36 is also applied to enclose the frame retaining sleeve 30 at the other portions of the side edges 22, 24, 26, 28 where no corner pieces 34 or other fabric are attached thereto.

A removable panel piece 38 may be supported from the support frame 20. The panel piece 38 can be of any size (i.e., it can even be large enough to cover the entire support frame 20, as shown by panel piece 38*a* in FIG. 1C) and can take the form of a fabric piece having a message, sign, indicia, illustration, amusement feature (e.g., netting or basket or bullseye target, etc.), game feature, or anything else provided thereon. For example, the panel piece 38 is illustrated in its simplest form in FIG. 1A as having an indicia or illustration 40 provided or printed on one or both surfaces. The panel piece 38 can have any shape or size, and is provided with a plurality of attachment mechanisms 42 (such as straps, strings, ropes, ties, hooks, opposing Velcro™ pads, etc.) that couple the panel piece 38 to the sides 22, 24, 26, 28 of the support frame 20, yet allows the panel piece 38 to be detached therefrom when desired. For example, FIG. 1A shows the use of strings 42 that have one end 44 permanently attached (e.g., by stitching) to the panel piece 38 and an opposing free end 46 that can be tied to the support frame 20. As another example, Velcro™ pads or straps 42*a* can be permanently attached (e.g., by stitching) to the panel piece 38*a* in FIG.1 C for coupling to the support frame 20. Although certain attachment mechanisms 42 are illustrated herein, it is possible to use any known and conventional attachment mechanism that is adapted for use with the specific size, shape and other requirements of the panel piece 38.

Thus, the user can conveniently replace the panel piece 38 shown in FIG. 1A with a different panel piece that has a different display, or game, or feature, by simply untying or detaching the attachment mechanisms 42 from the support frame 20, removing the panel piece 38, and securing a different panel piece to the support frame 20. This allows the same support frame 20 to be used for supporting different panel pieces 38. In addition, even though only one panel piece 38 is illustrated in FIG. 1A, it is possible for the support frame 20 to support a plurality of panel pieces 38, as illustrated in the other embodiments below.

Figure 2A:
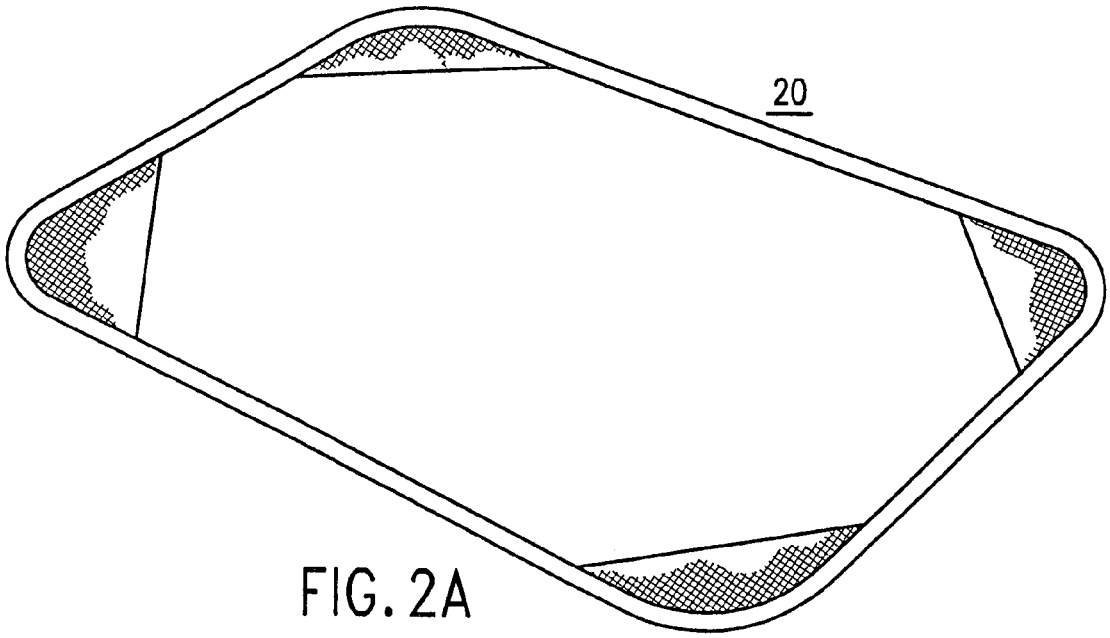
FIGS. 2A-2E illustrate how the support frame of FIG. 1A is folded and collapsed.
Figure 2B:
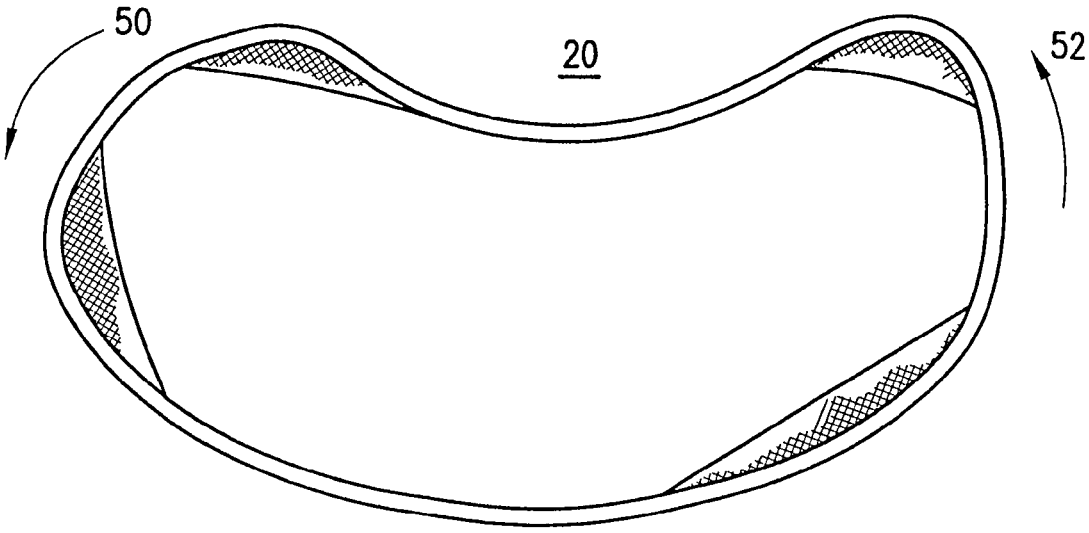
Figure 2C:
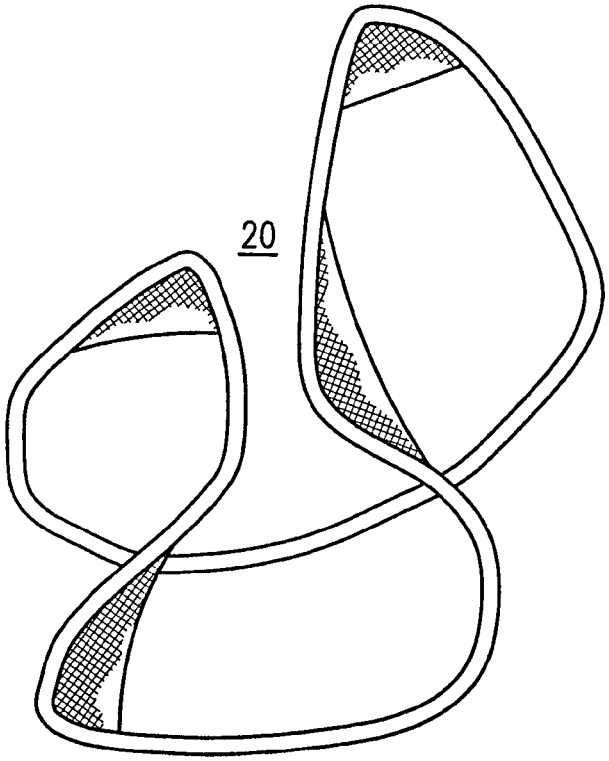
Figure 2D:
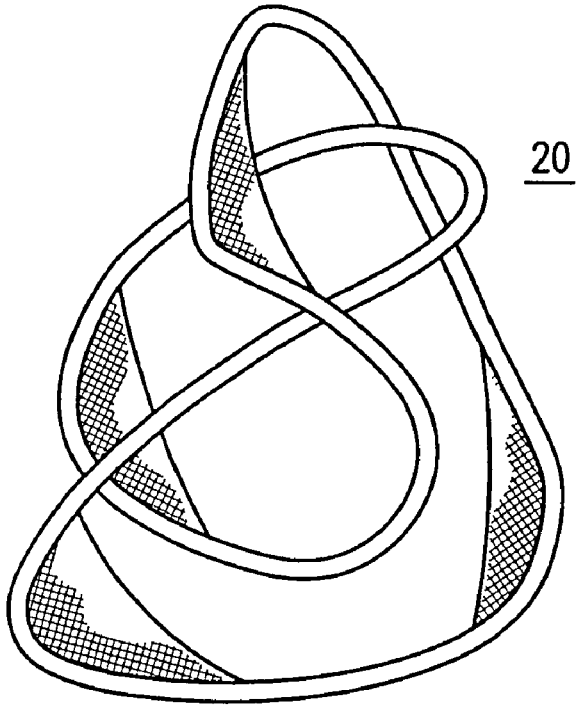
Figure 2E:
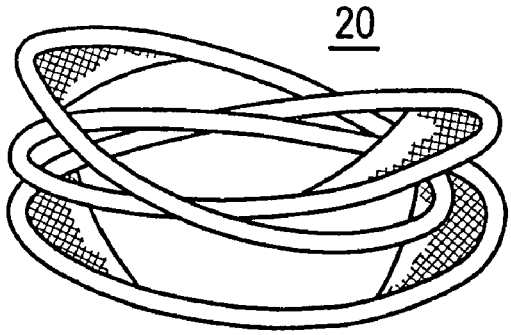

The support frame 20 can also be folded and collapsed into a compact configuration for storage, as illustrated in FIGS. 2A-2E. FIG. 2A shows the support frame 20 without the panel piece 38, ready to be folded. First, as shown in FIG. 2B, two opposite sides of the support frame 20 are folded in opposite directions (see arrows 50 and 52) cause the support frame 20 to be coiled and collapsed (see FIG. 2C). As shown in FIG. 2D, the collapsing is continued so that the initial size of the support frame 20 is reduced. Finally, the support frame 20 is collapsed on itself to provide for a small essentially compact configuration having a plurality of concentric frame members 32 so that the collapsed support frame 20 has a size which is a fraction of the size of the initial support frame 20, as shown in FIG. 2E. Thus, the support frame 20 can be folded and stored very quickly using the steps illustrated in FIGS. 2A-2E.

To re-open the support frame 20 to its expanded configuration, the collapsed support frame 20 is unfolded. The memory (i.e., spring-load) of the frame member 32 will cause the frame member 32 to uncoil on its own and quickly expand the support frame 20 to the expanded configuration shown in FIG. 1A. The above-described methods and principles for folding and collapsing a support frame 20, and for re-opening the support frame 20 to deploy it for use, can be applied to all the embodiments illustrated hereinbelow.

Figure 3:
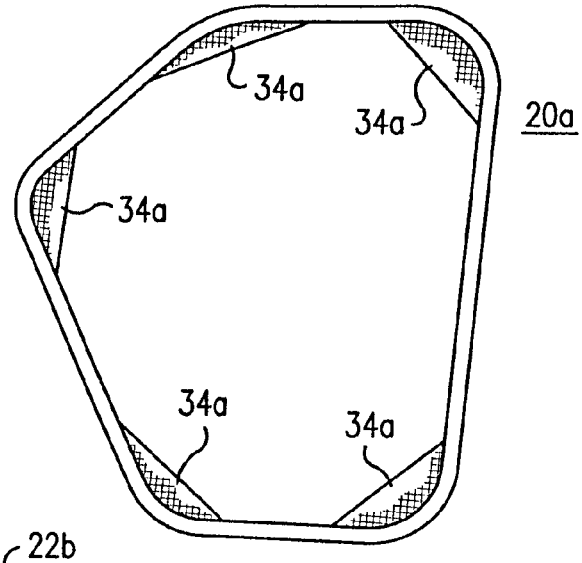
FIGS. 3-5 illustrate singular support frames similar to the support frame of FIG. 1A, but having different shapes.
Figure 4:
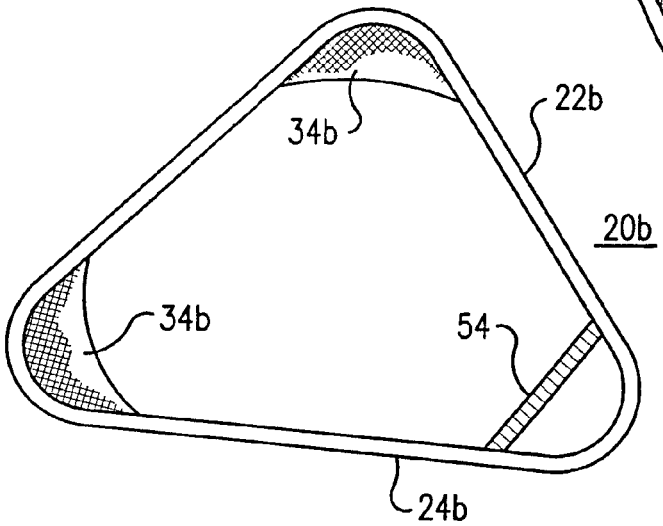
Figure 5:
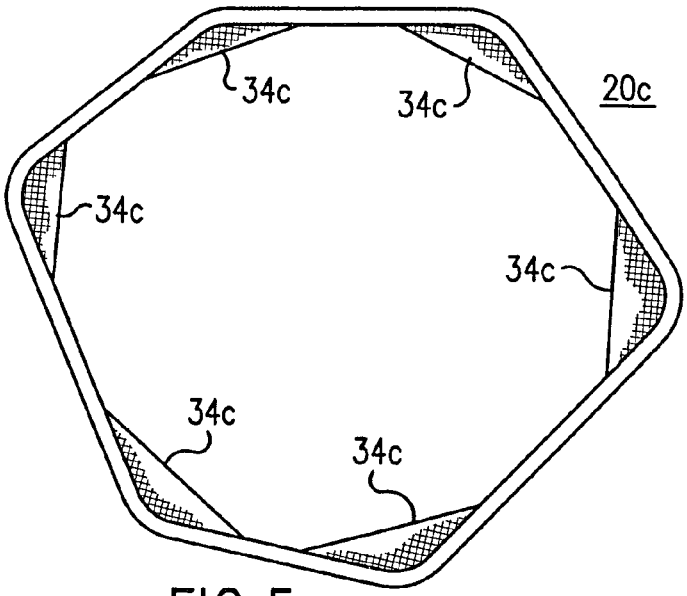

FIG. 3 illustrates a singular support frame 20*a* that is the same as support frame 20 of FIG. 1A, except that support frame 20*a* has five sides defined by the five corner pieces 34*a*. Similarly, FIG. 4 illustrates a singular support frame 20*b* that is the same as support frame 20 of FIG. 1A, except that support frame 20*b* has three sides defined by the three corner pieces 34*b*. Note that one of the corner pieces 54 is provided in the form of a strap that is held taut between the two adjacent sides 22*b* and 24*b*. Similarly, FIG. 5 illustrates a singular support frame 20*c* that is the same as support frame 20 of FIG. 1A, except that support frame 20*c* has six sides defined by the six corner pieces 34*c*. Panel pieces 38 are not shown in FIGS. 3-5, 9, 10, 12 and 14-16 to simplify those illustrations, but it is intended that any of the support frames in these FIGS. can be used to support one or more panel pieces 38.

Figure 6A:
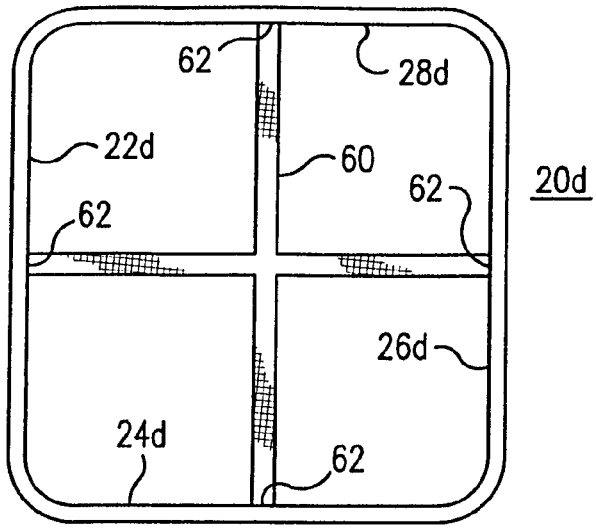
FIGS. 6A, 6B and 7 illustrate singular support frames according to other embodiments of the present invention shown in use in their expanded configuration.
Figure 6B:
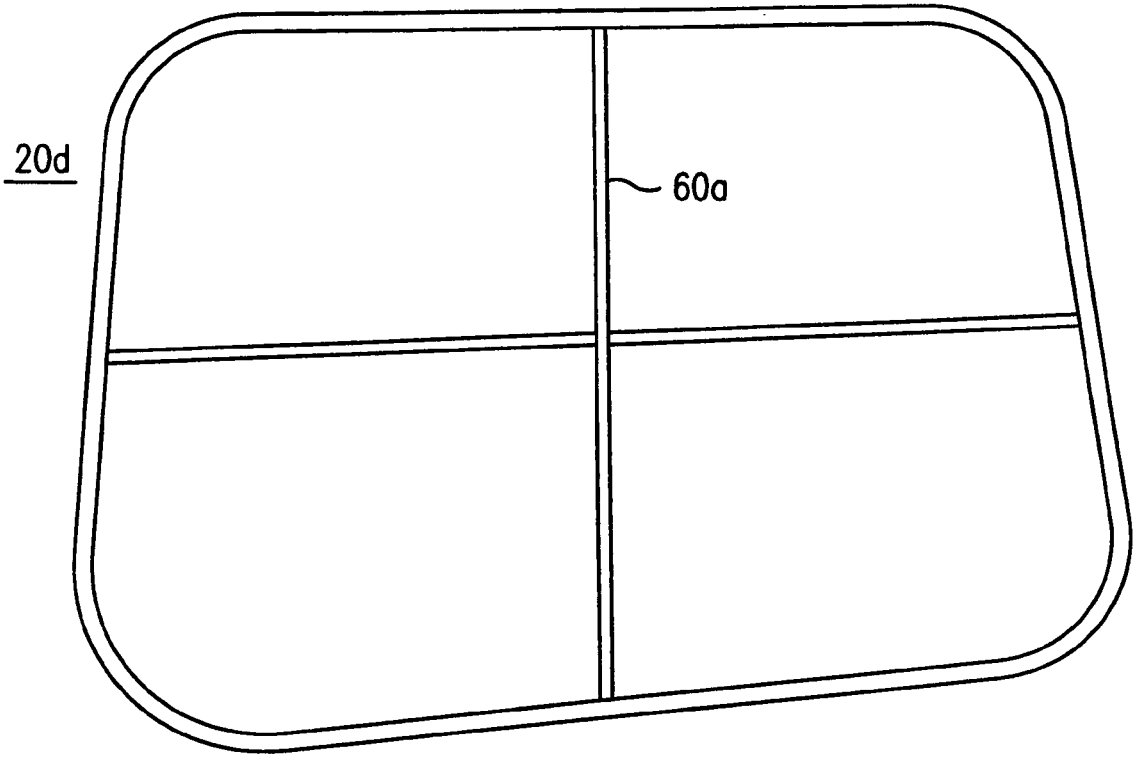

In the support frames 20, 20*a*, 20*b* and 20*c* described above, the panel piece 38 can be supported from the sides of the support frame itself. However, to increase the number of panel pieces 38 that can be supported by a support frame, and to allow for variations in how these panel pieces 38 can be arranged in a support frame, it is possible to provide one or more support pieces, such as 60 in FIG. 6A. Referring to FIG. 6A, a singular support frame 20*d* is provided that is the same as support frame 20 of FIG. 1A, except that the corner pieces 34 have been omitted, and instead, a cross-shaped support piece 60 having four legs is provided. Each leg of the support piece 60 has an end 62 that is attached (e.g., in a permanent manner by stitching, or in a detachable manner by Velcro™ pads, straps, ties, hooks or similar mechanisms) to a separate side 22*d*, 24*d*, 26*d* and 28*d* of the support frame 20*d*. The support piece 60 and its legs also help to define the shape of the support frame 20*d*, since the four separate ends 62 each define one side of the support frame 20*d*. The support piece 60 can be made of a durable fabric, wire, strap, rubber, or soft plastic material. For example, the support piece 60*a* in FIG. 6B can be either a wire, strap, rubber piece or soft plastic piece. The support piece 60 or 60*a* can be used alone, or together with the support frame 20*d*, to support one or more panel pieces or items.

Figure 7:
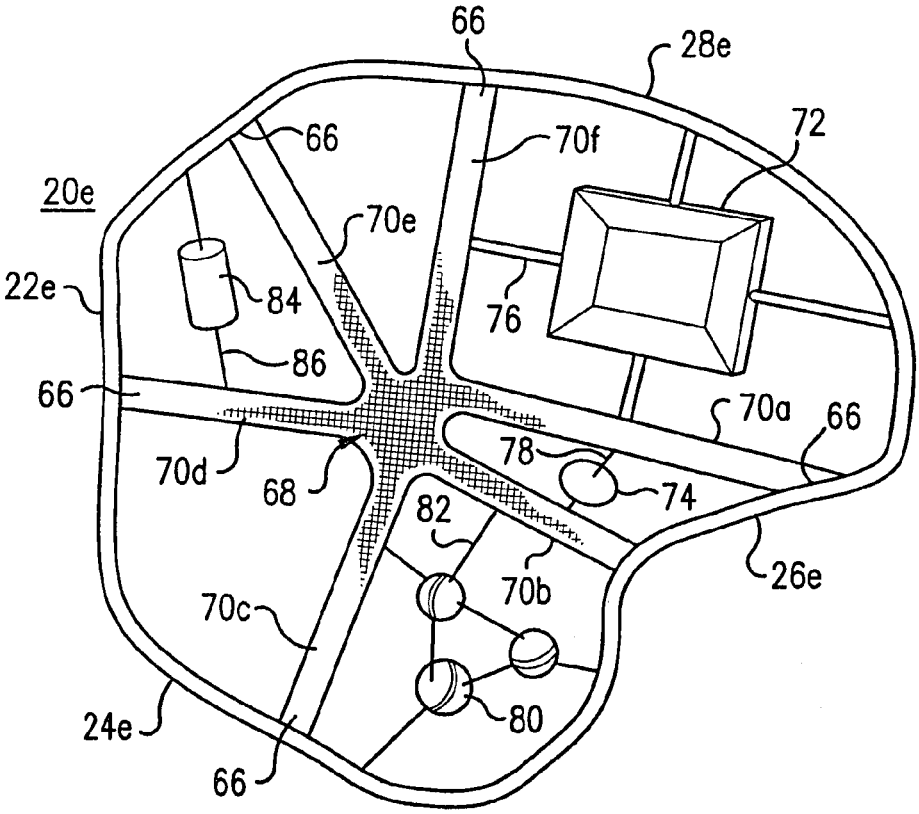

This is illustrated in greater detail in FIG. 7, where the singular support frame 20*e* has an irregular shape that is defined by the various ends 66 of the support piece 68. The support frame 20*e* is essentially the same as support frame 20*d* of FIG. 6, except that the support piece 68 has an irregular shape having six separate legs 70, each having different lengths to cause the support frame 20*e* to assume the irregular configuration shown in FIG. 7. For example, leg 70*a* is longer than leg 70*b*, which causes the same "side" 26*e* to be curved in several locations. A large variety of items can be supported by the support frame 20*e* and the support piece 68. For example, a picture frame 72 can be supported by attaching straps, strings or ties 76 to the picture frame 72 and the sides 26*e* and 28*e* of support frame 20*e*, and legs 70*a* and 70*f* of support piece 68. A rotating ball 74 can be supported by a shaft 78 that has opposing ends attached to legs 70*a* and 70*b*. An arrangement of rotating balls 80 can be supported by shafts, strings or ties 82 that have opposing ends attached to sides 24*e* and 26*e* and to legs 70*b* and 70*c*. A rotatable tin can 84 or other object can be supported by a shaft or string 86 that has opposing ends attached to leg 70*d* and side 22*e*. Thus, as shown in FIG. 7, some items (such as picture frame 72, the arrangement of balls 80, and tin can 84) are supported by both a side of the support frame 20*e* and a leg of the support piece 68, while other items (such as ball 74) is supported by two or more adjacent legs 70 of the support piece 68 without support from the support frame 20*e*.

Figure 8A:
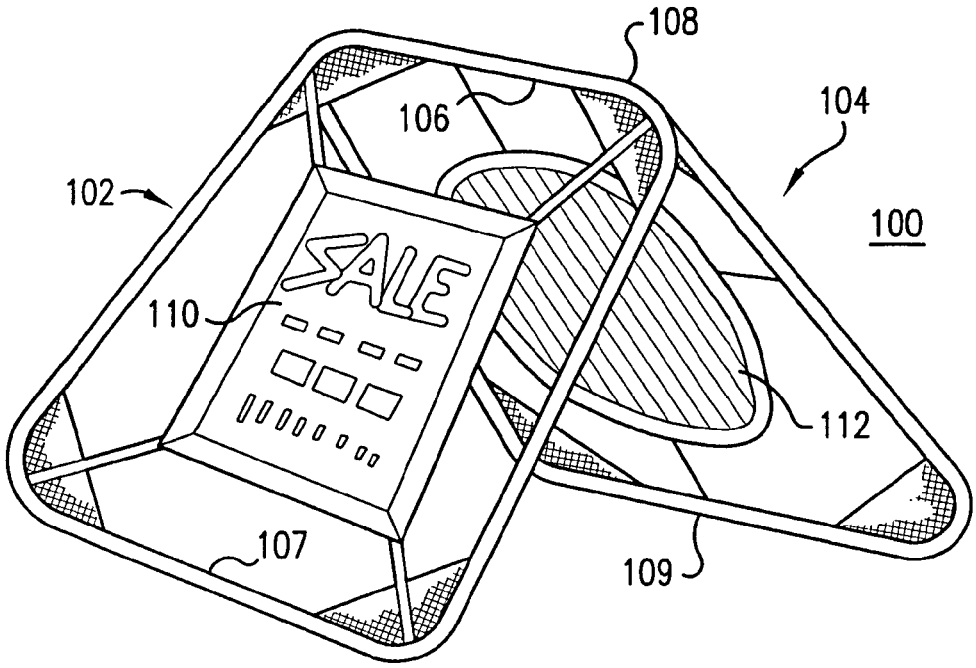
FIGS. 8-11 illustrate collapsible support frame structures having a plurality of singular support frames according to other embodiments of the present invention shown in use in their expanded configuration.

The support frame structures of the present invention can have two or more support frames. Referring to FIG. 8A, the support frame structure 100 has two support frames 102 and 104, each of which can have the same construction as support frame 20 of FIG. 1A. Each support frame 102, 104 has four sides, and are hingedly coupled together along their top sides 106 and 108, respectively. This hinged coupling can be accomplished in a permanent manner by stitching the frame retaining sleeves of the support frames 102, 104 along the top sides 106, 108, or in a detachable manner by using a detachable attachment mechanism such as Velcro™ pads, ties, straps, hooks and similar mechanisms. When coupled in the manner shown in FIG. 8, the support frames 102, 104 together form an inverted V-shape structure with each support frame 102, 104 angled with respect to the ground and each other, and with a bottom side 107, 109 of each support frame 102, 104, respectively, adapted to rest on the ground or surface. Each support frame 102, 104 can support one or more panel pieces 110, 112, respectively, that can be coupled to the support frames 102, 104 according to the techniques described above. In this embodiment, the panel piece 110 can display a "sale" sign, and the other panel piece 112 can display another message.

The support frame structure 100 of FIG. 8A can be folded and collapsed by first folding one support frame 102 or 104 on to the other support frame 104 or 102 about the hinged coupling of the top sides 106, 108 to create a stack of two support frames 102, 104. This stack of two support frames 102, 104 can then be twisted and folded according to the method of FIGS. 2A-2E.

Figure 8B:
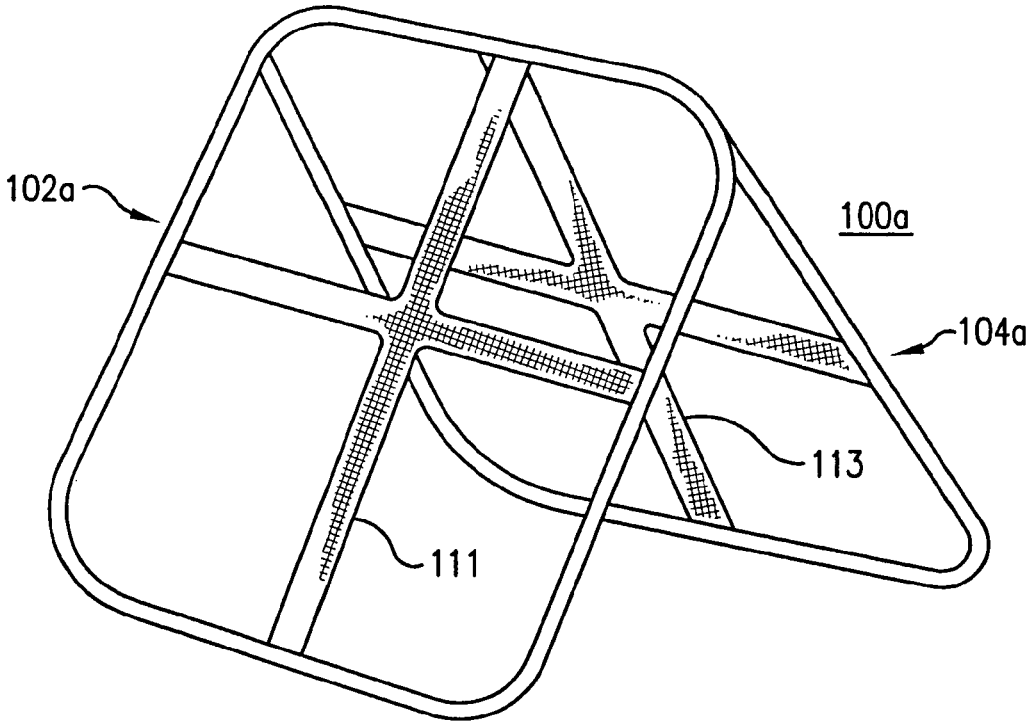

FIG. 8B illustrates a modification that can be made to the structure 100 of FIG. 8A. In FIG. 8B, the structure 100*a* is essentially the same as structure 100, except that each support frame 102*a*, 104*a* is provided with a cross-shaped support piece 111 and 113, respectively, similar to support piece 60 in FIG. 6A. Objects and panel pieces can be supported from these support pieces 111, 113 and the support frames 102*a*, 104*a*.

Figure 9:
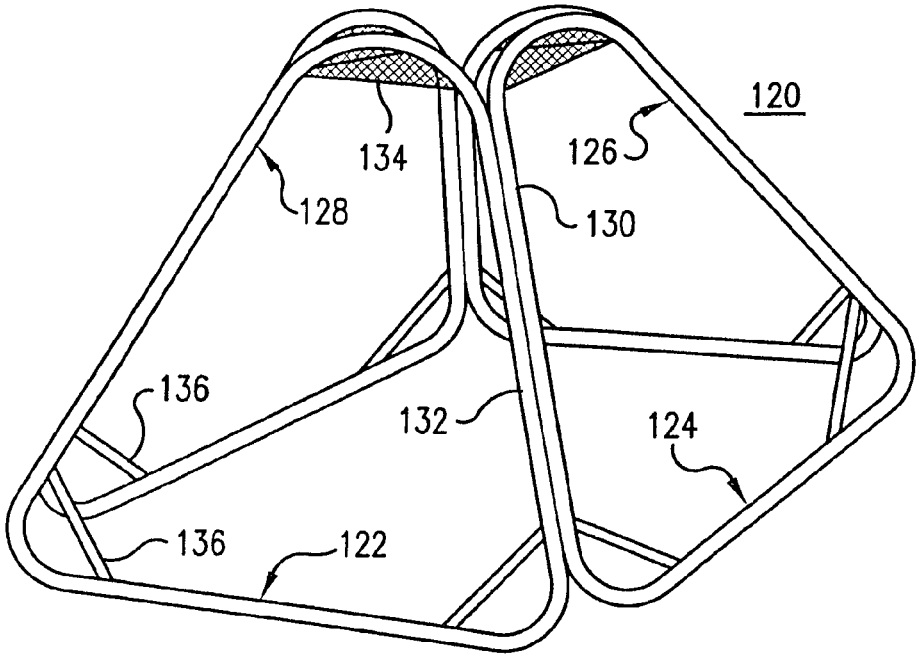

FIG. 9 illustrates a four-sided support frame structure 120 having four support frames 122, 124, 126 and 128, each of which can have the same construction as support frame 20 of FIG. 1A but having a different shape. Each support frame 122, 124, 126, 128 has three sides, and the left side 130 of each support frame 122, 124, 126, 128 is hingedly coupled to a right side 132 of an adjacent support frame to form an enclosed space inside the four support frames 122, 124, 126, 128. These hinged couplings can also be accomplished in a permanent manner or in a detachable manner by using the mechanisms described above. Three corner pieces (which can be fabric pieces 134 or straps 136) are provided at the three corners of each support frame 122, 124, 126, 128. Each support frame 122, 124, 126, 128 can support one or more panel pieces (not shown) that can be coupled to the support frames 122, 124, 126, 128 according to the techniques described above. For example, a user can provide a panel piece that completely covers a frame to act as a side wall. In this manner, if each support frame 122, 124, 126, 128 is provided with a panel piece that covers the frame, then the user can essentially provide a collapsible shelter having four different panel pieces. These panel pieces can be removed and replaced by other panel pieces having different designs or patterns or amusement features to vary the appearance of the collapsible shelter.

The support frame structure 120 of FIG. 9 can be folded and collapsed by first pushing support frames 122 and 124 against support frames 128 and 126, respectively, about the hinged coupling of the left and right sides 130, 132. The combined support frames 122, 128 can then be folded on to the combined support frames 124, 126 about the hinged couplings to create a stack of four support frames 122, 128, 126, 124, in this order. This stack of four support frames can then be twisted and folded according to the method of FIGS. 2A-2E.

Figure 10:
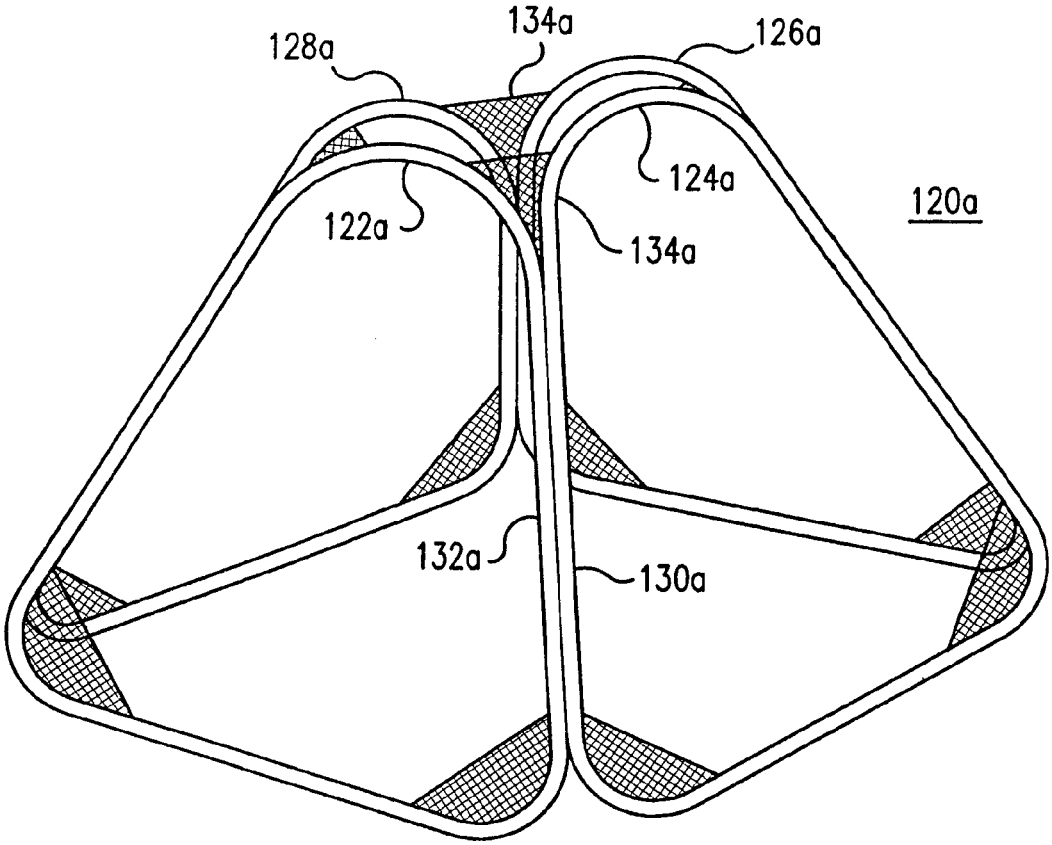

FIG. 10 illustrates a support frame structure 120*a* that is essentially the same as support frame 120 of FIG. 9, except that the top corner pieces 134*a* are attached in a taut manner between adjacent support frames 122*a*, 124*a*, 126*a*, 128*a* (also known as "external corner pieces"). Specifically, the top corner pieces that are normally provided within the confines of a corner of a specific support frame 122*a*, 124*a*, 126*a*, 128*a* (also known as "internal corner pieces") are now omitted, and replaced by external corner pieces 134*a* that are attached to two adjacent support frames 122*a*, 124*a*, 126*a*, 128*a* in the space between these adjacent support frames. The external corner pieces 134*a* provide the benefit of keeping the interior of the support frames 122*a*, 124*a*, 126*a*, 128*a* open and clear for use in supporting objects or other items, since the internal corner pieces will invariably intrude into the space defined by the interior of the support frames 122*a*, 124*a*, 126*a*, 128*a*. Both the interior corner pieces and the external corner pieces perform the same function of defining the shape of the support frames 122*a*, 124*a*, 126*a*, 128*a*.

Figure 11:
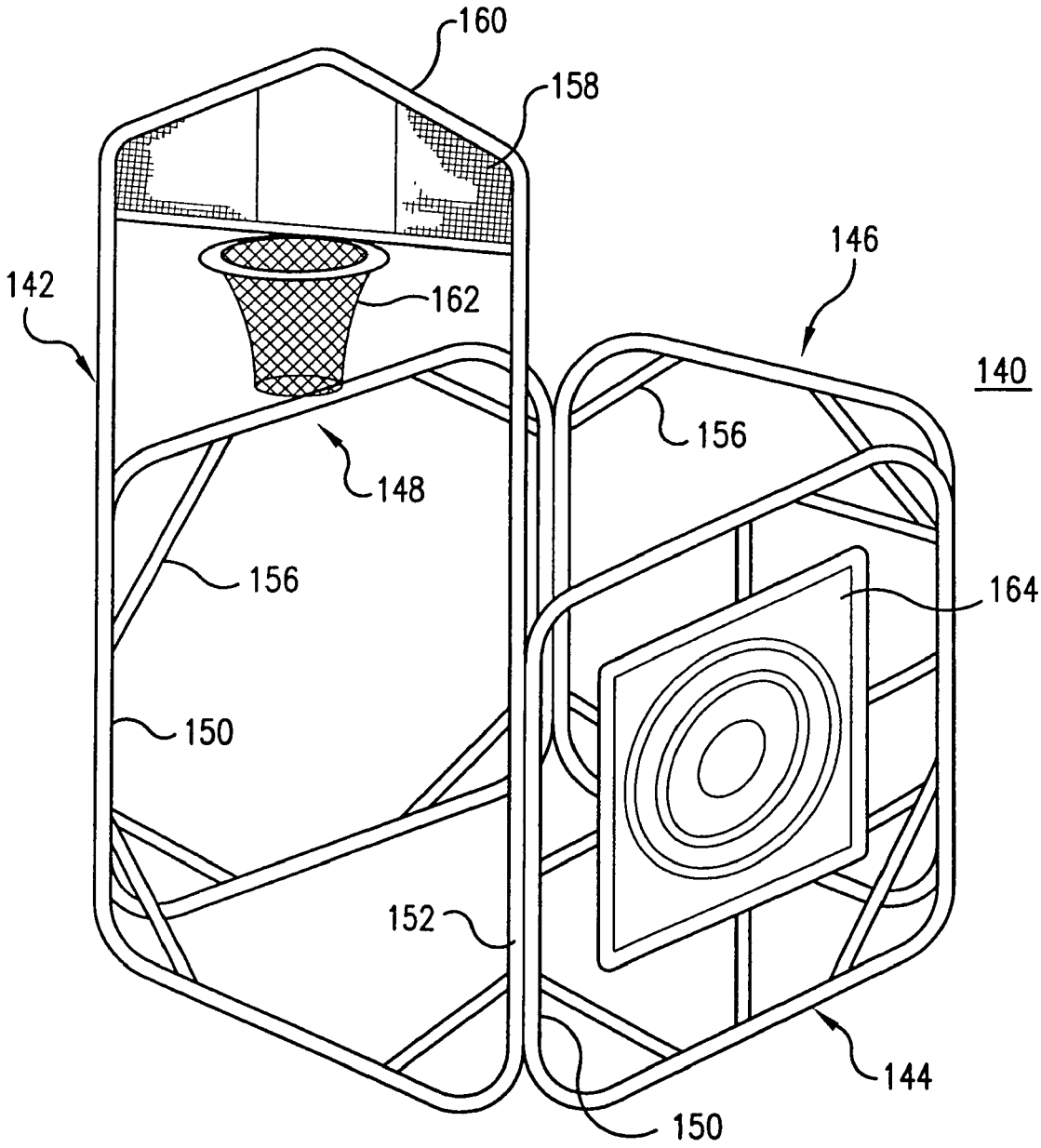

FIG. 11 illustrates a four-sided support frame structure 140 having four support frames 142, 144, 146 and 148, each of which can have the same construction as support frame 20 of FIG. 1A. Each support frame 142, 144, 146, 148 has four sides, and the left side 150 of each support frame 142, 144, 146, 148 is hingedly coupled to a right side 152 of an adjacent support frame to form an enclosed space inside the four support frames 142, 144, 146, 148. These hinged couplings can also be accomplished in a permanent manner or in a detachable manner by using the mechanisms described above. Four corner pieces (e.g., straps 156) are provided at the four corners of each support frame 142, 144, 146, 148. One support frame 142 has longer left and right sides 150, 152, so that a fabric piece 158 can be attached (e.g., by stitching) to the top side 160 of support frame 142. A basket or netting 162 can be attached to fabric piece 158 so that support frame 142 can be used to support a backboard. The support frame 142 can support one or more other panel pieces that can be coupled to the support frame 142 according to the techniques described above. Another support frame 144 can support a panel piece 164 that includes a "bulls-eye" target. Although not shown, the other support frames 146 and 148 can support one or more panel pieces that can be coupled to the support frames 146, 148 according to the techniques described above. Thus, the structure 140 allows the user to change panel pieces for each support frame 142, 144, 146, 148 to increase the variety of play.

Figure 12:
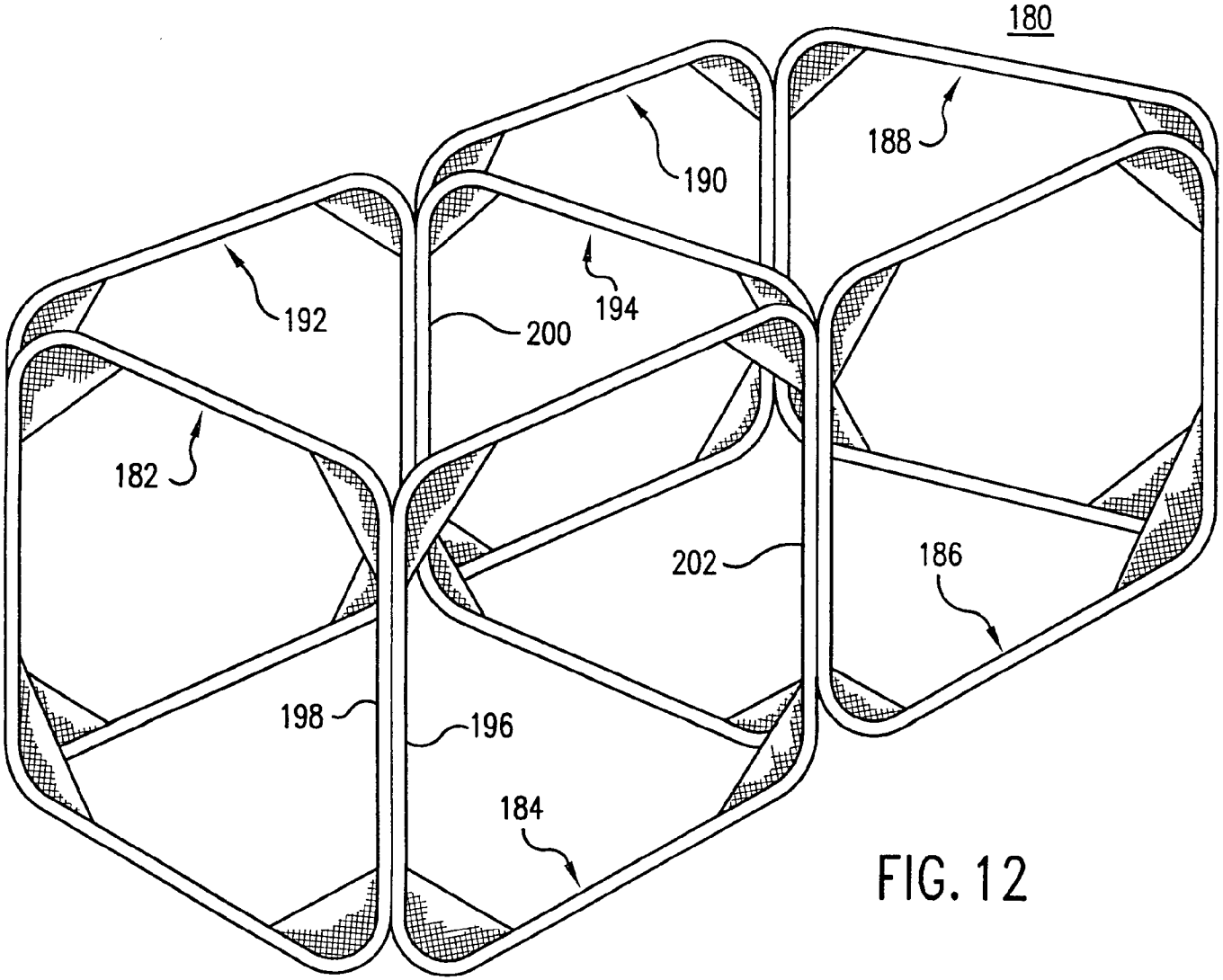
FIG. 12 illustrates a collapsible support frame structure having a plurality of singular support frames according to yet another embodiment of the present invention shown in use in its expanded configuration.
Figure 13:
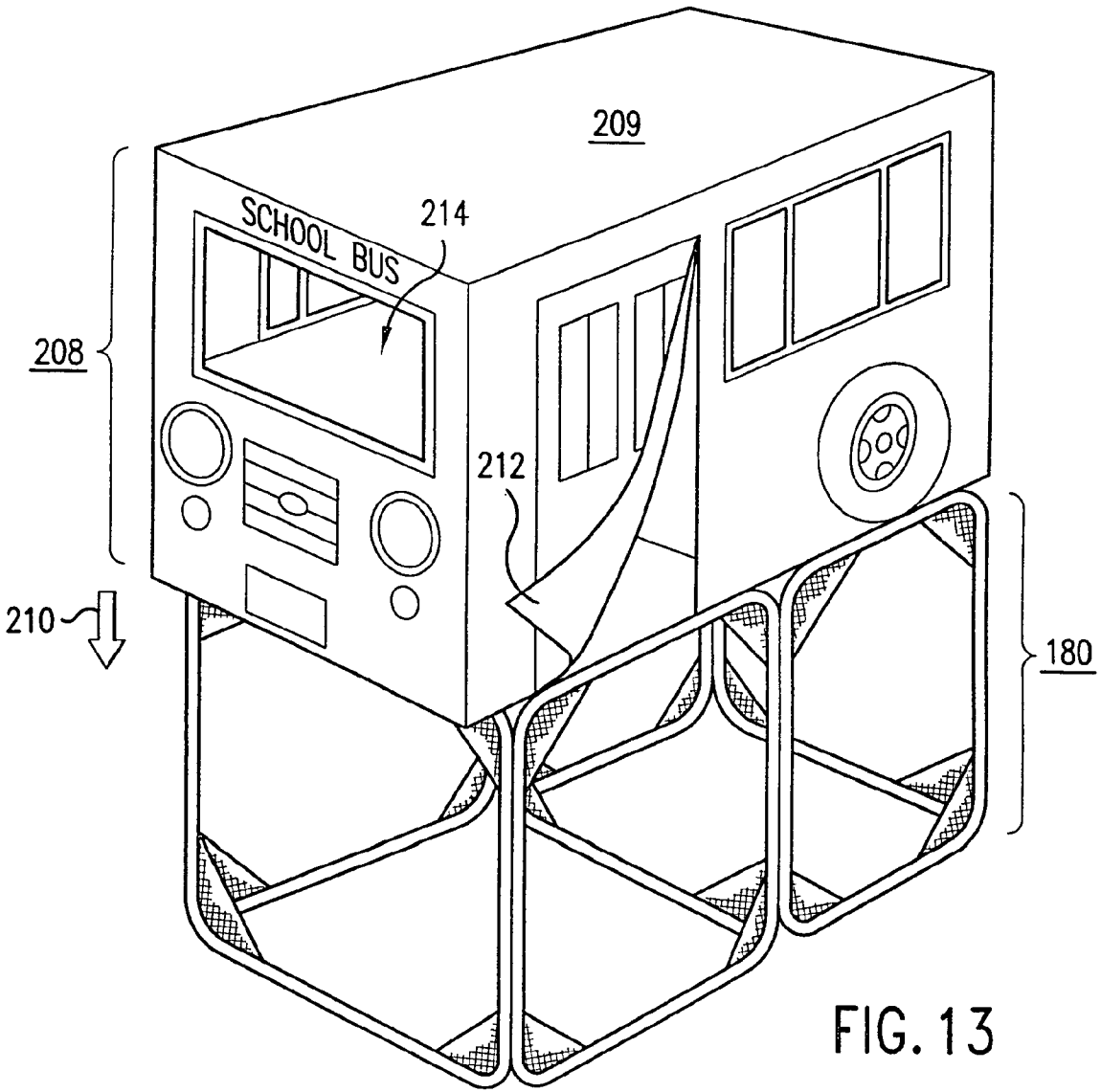
FIG. 13 illustrates how a covering fabric can be supported by the support frame structure of FIG. 12.

The support frame structures of the present invention can also be used to support different coverings. Referring to FIGS. 12 and 13, a support frame structure 180 is provided having seven support frames 182, 184, 186, 188, 190, 192 and 194, each of which can be the same as support frame 20 of FIG. 1A. Each of the six outer support frames 182, 184, 186, 188, 190, 192 has four sides, and the left side 196 of each of these support frames 182, 184, 186, 188, 190, 192 is hingedly coupled to a right side 198 of an adjacent support frame to form an enclosed space inside the six outer support frames 182, 184, 186, 188, 190, 192. The inner support frame 194 is provided inside the enclosed space, with one side 200 of the inner support frame 194 hingedly coupled to the hinged coupling between support frames 190 and 192, and another side 202 of the inner support frame 194 hingedly coupled to the hinged coupling between support frames 184 and 186. These hinged couplings can also be accomplished in a permanent manner or in a detachable manner by using the mechanisms described above. Support frame 194 is positioned to provide additional stability to the structure 180.

The structure 180 can be folded and collapsed by first pushing support frames 182 and 184 against support frames 192 and 194, respectively, and by pushing support frames 186 and 188 against support frames 194 and 190, respectively, about the hinged couplings of the left and right sides 196, 198 of the respective support frames. The combined support frames 182, 192 can then be folded on to the combined support frames 184, 194, and the combined support frames 188, 190 can then be folded on to the combined support frames 186, 194, about the hinged couplings, to create a stack of seven support frames 192, 182, 184, 194, 186, 188, 190, in this order. This stack of seven support frames can then be twisted and folded according to the method of FIGS. 2A-2E.

Referring now to FIG. 13, a covering 208 can be draped or otherwise placed over the support frame structure 180. The covering 208 can be sized and shaped to correspond to the size and shape of the support frame structure 180, and can be made from a fabric, cardboard, meshed, or other material. In this regard, the covering 208 also has four sides to create a rectangular shape, and can include a top or roof cover 209. The bottom of the covering 208 can be open so that the covering 208 can be draped over the support frame structure 180 in the direction of arrow 210 as shown in FIG. 13. Each covering 208 can be provided with different designs, patterns, indicia, games or amusement. For example, the covering 208 shown in FIG. 13 can be decorated to look like a school bus, including an opening 212 cut from a side of the covering 208 to allow ingress and egress to and from the interior of the structure 180, and an opening 214 cut from the front side to form a front windshield. Thus, the user can replace this covering 208 with another covering bearing a different theme, pattern, design, game or amusement, so that the support frame structure 180 can be used to support a wide variety of coverings, thereby increasing the utility of the support frame structure 180.

Figure 14:
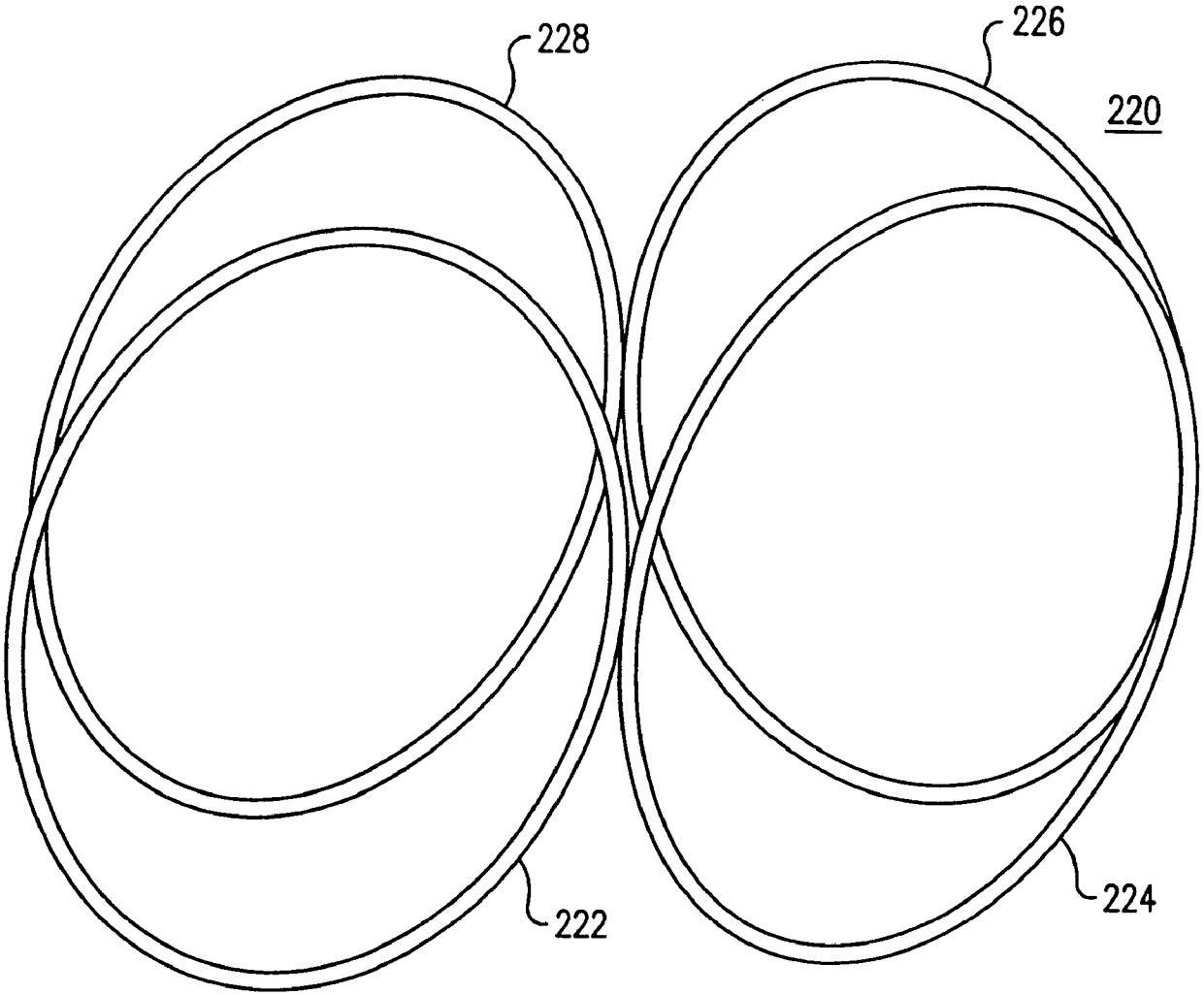
FIGS. 14 and 15 illustrate collapsible support frame structures having a plurality of singular support frames according to further embodiments of the present invention shown in use in their expanded configuration.

FIG. 14 illustrates a four-sided support frame structure 220 having four support frames 222, 224, 226 and 228, each of which can have the same construction as support frame 20 of FIG. 1A, except that each support frame 222, 224, 226, 228 is generally circular in configuration, with each support frame 222, 224, 226, 228 hingedly coupled to an adjacent support frame at their circumferences to form an enclosed space inside the four support frames. These hinged couplings can also be accomplished in a permanent manner or in a detachable manner by using the mechanisms described above. Since the shape of each support frame 222, 224, 226, 228 is generally circular, no corner pieces (such as 34) are needed. The structure 220 can be folded and collapsed using the same technique for the support frame structures 120, 120*a* and 140 in FIGS. 9-11.

Figure 15:
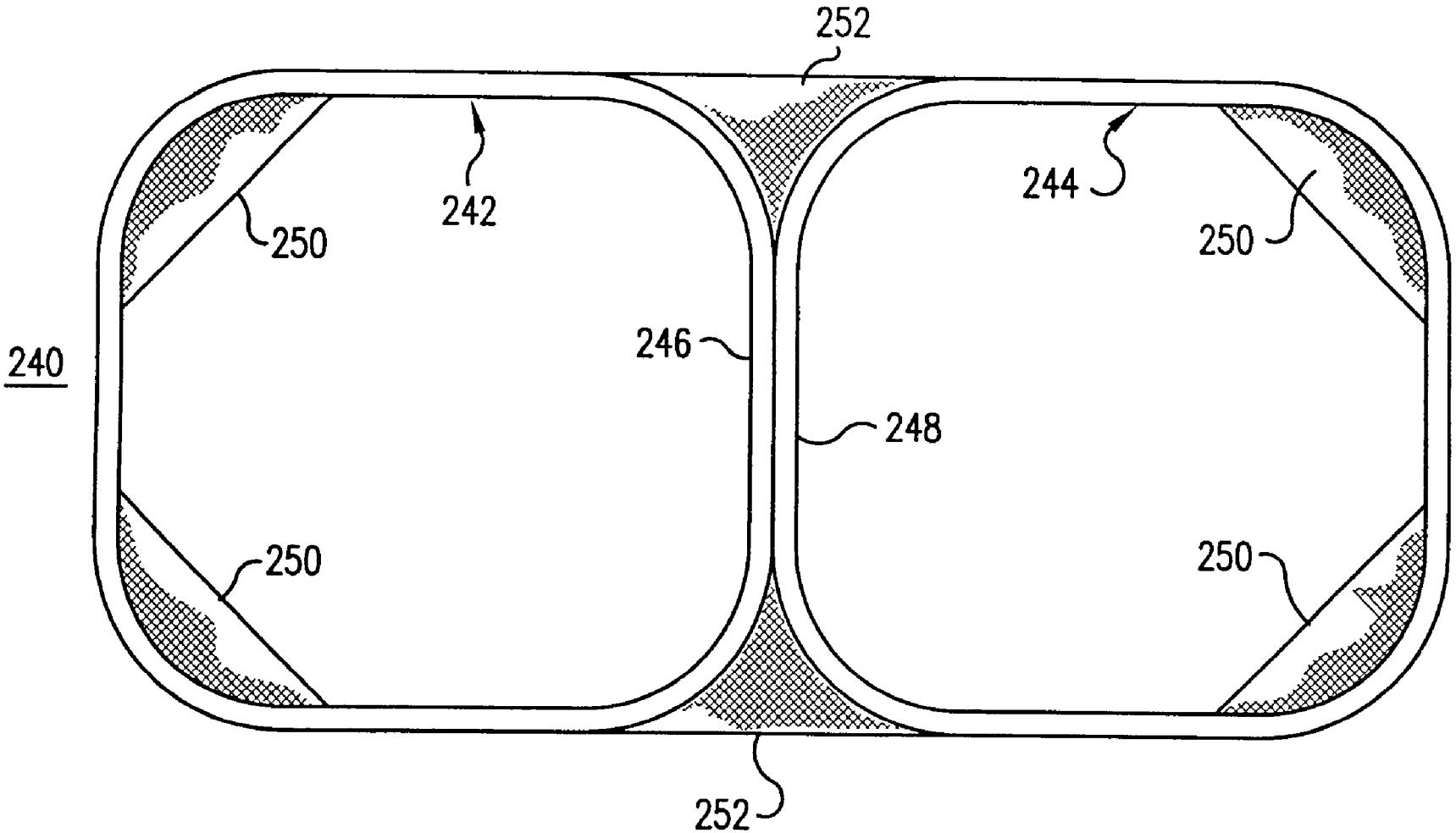

FIG. 15 illustrates a support frame structure 240 having two support frames 242 and 244, each of which can have the same construction as support frame 20 of FIG. 1A, except that each support frame 242, 244 has a different shape. The support frames 242 and 244 are hingedly coupled along the right side 246 of support frame 242 and the left side 248 of support frame 244. This hinged coupling can also be accomplished in a permanent manner or in a detachable manner by using the mechanisms described above. The shapes of the support frames 242, 244 are defined by the various corner pieces. For example, each support frame 242, 244 has two internal corner pieces 250 attached within the respective support frame 242 or 244. In addition, two external corner pieces 252 are attached to the outside of the other corners of the support frames 242, 244, such that these external corner pieces 252 actually attach and couple between the two support frames 242, 244 in a manner similar to external corner pieces 134*a* in FIG. 10. The structure 240 can be folded and collapsed using the same technique for the support frame structure 100 in FIG. 8.

Figure 17:
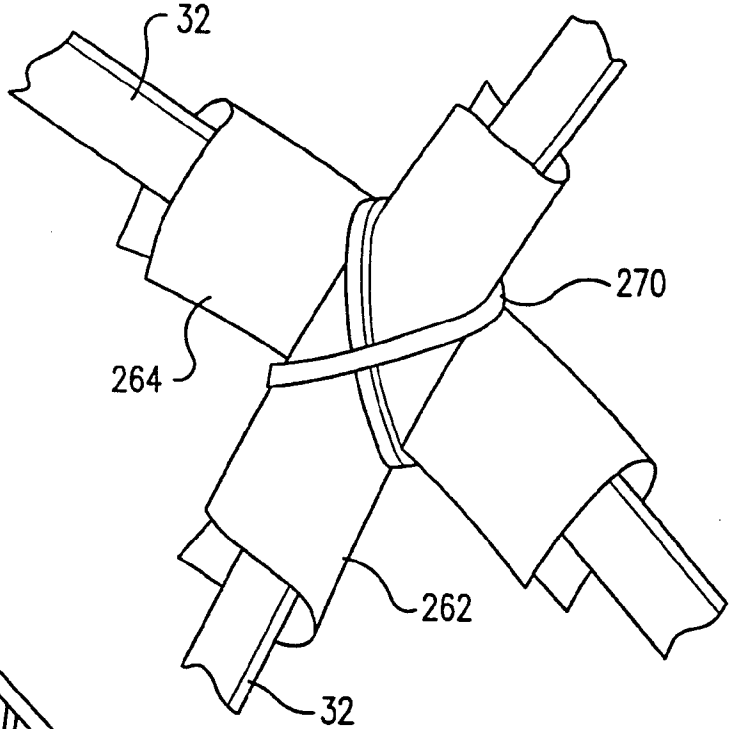
FIG. 17 is a partial cut-away view of the section B of the support frame structure of FIG. 16.
Figure 16:
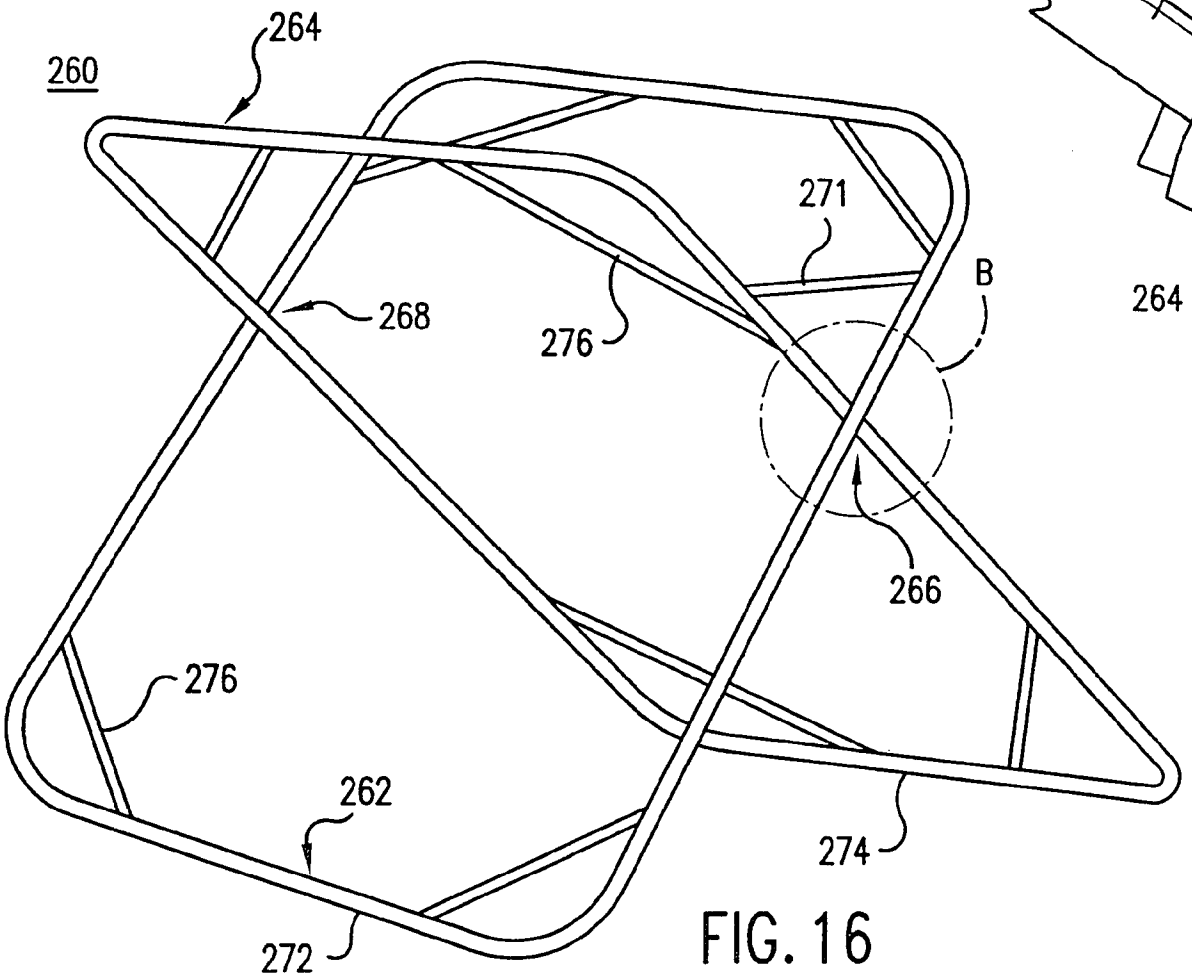
FIG. 16 illustrates a collapsible support frame structure having a plurality of crossing singular support frames according to yet a further embodiment of the present invention shown in use in its expanded configuration.

FIGS. 16 and 17 illustrate another embodiment of a support frame structure 260 according to the present invention. The support frame structure 260 has two support frames 262 and 264, each of which can be the same as support frame 20 of FIG. 1A. The support frames 262, 264 cross or intersect at an angle, and can be provided in this intersecting configuration by providing one support frame (e.g., 264) with a slightly smaller width so that it can be fitted inside the confines of the other support frame 262, and then coupling the two support frames 262, 264 at their two crossing or intersection points 266 and 268. One intersection point 266 is shown in greater detail in FIG. 17 (the other intersection 268 being the same), where a string or tie 270 can be used to tie the support frames 262, 264 together in a manner that allows them to pivot with respect to each other at these intersection points 266, 268. Thus, to deploy the structure 260, the support frames 262, 264 can be pivoted about the intersection points 266, 268 so that the bottom side 272 and 274 of each support frame 262 and 264, respectively, can be rested on a floor or surface (see FIG. 16). When in this configuration, the structure 260 is essentially self-supporting. As an alternative, a tie or strap 271 can have opposing ends secured (either permanently or detachably) to the support frames 262, 264 above an intersection point 266 or 268 to limit the extent to which the support frames 262, 264 can pivot. Corner pieces or straps 276 can be provided for each support frame 262, 264. To fold and collapse the structure 260, the support frames 262, 264 can be pivoted so that they are generally parallel to each other to form a stack of two support frames 262, 264. This stack of two support frames can then be twisted and folded according to the method of FIGS. 2A-2E.

Although not expressly shown in FIGS. 8-16, the structures shown in FIGS. 8-16 can also have support pieces like the support pieces 60 and 68 shown in FIGS. 6 and 7.

Thus, the present invention provides collapsible support frame structures that allow a variety of games, designs, indicia, messages, etc., to be supported thereon, and to be removed and replaced by others. This increases the utility and use of these collapsible support frame structures since they can be used to support many different games, designs, indicia, messages, etc., and also provides the user with increased variety in play and amusement.

While the description above refers to particular embodiments of the present invention, it will be understood that many modifications may be made without departing from the spirit thereof. The accompanying claims are intended to cover such modifications as would fall within the true scope and spirit of the present invention. For example, although the panel pieces 38, objects and other items have been described as being removable, it is also possible to attach panel pieces 38, objects and other items to the support frames in a permanent, non-removable manner.

What is claimed is:

1. A method of displaying images or messages, comprising:

providing a support frame having a foldable frame member that has a folded and an unfolded orientation, the frame member defining a periphery for the support frame, wherein the frame member is collapsible to the folded position by twisting and folding to form a plurality of concentric rings to substantially reduce the size of the support frame in the folded position;

coupling a first covering to the support frame, the first covering having a first image;

removing the first covering from the support frame; and coupling a second covering to the support frame, the second covering having a second image.

2. The method of claim 1, wherein coupling the first covering to the support frame comprises:

placing the first covering over but not enclosing the support frame, the covering having the same configuration as the frame member in the unfolded orientation.

3. The method of claim 1, further including retaining the frame member inside a frame retaining sleeve.

4. The method of claim 1, wherein the support frame is a first support frame, further including:

providing a second support frame having a foldable frame member that has a folded and an unfolded orientation, the frame member of the second support frame defining a periphery for the second support frame; and hingedly connecting the first and second support frames each other.

5. The method of claim 4, further including:

hingedly connecting the top edges of the first and second support frames each other.

6. The method of claim 4, further including:

coupling a third covering to the second support frame, the third covering having a third image.

* * * * *